62-55.5 SP
10/15/85 CR 4,546,613

United States Patent [19]
Eacobacci et al.

[11] Patent Number: 4,546,613
[45] Date of Patent: Oct. 15, 1985

[54] CRYOPUMP WITH RAPID COOLDOWN AND INCREASED PRESSURE

[75] Inventors: Michael J. Eacobacci, Randolph; Donald A. Olsen, Millis, both of Mass.

[73] Assignee: Helix Technology Corporation, Waltham, Mass.

[21] Appl. No.: 684,967

[22] Filed: Dec. 20, 1984

Related U.S. Application Data

[63] Continuation of Ser. No. 481,783, Apr. 4, 1983, abandoned.

[51] Int. Cl.[4] ..... B01D 8/00
[52] U.S. Cl. ..... 62/55.5; 55/269; 62/100; 62/268; 417/901
[58] Field of Search ..... 62/55.5, 100, 268, 467; 55/269; 417/901

[56] References Cited

U.S. PATENT DOCUMENTS

| | | | |
|---|---|---|---|
| 3,122,896 | 3/1964 | Hickey | 62/55.5 |
| 3,130,562 | 4/1964 | Wood et al. | 62/55.5 |
| 3,131,396 | 4/1964 | Santeler et al. | 62/55.5 |
| 3,218,815 | 11/1965 | Chellis et al. | 62/6 |
| 4,311,018 | 1/1982 | Welch | 62/55.5 |
| 4,356,701 | 11/1982 | Bartlett et al. | 62/55.5 |

OTHER PUBLICATIONS

Welch, Kimo M. and Chris Flegal, "Helium Cryopumping", *Industrial Research/Development*, Mar. 1979, pp. 83–88.

Singer, Peter H., "Update of Cryogenic Pumps", *Semiconductor International*, Oct. 1982, pp. 89–99.

CTI-Cryogenics Manual, "Operation and Maintenance Instructions with Illustrated Parts Breakdown, Cropump System", 1976, 1977.

*Primary Examiner*—Ronald C. Capossela
*Attorney, Agent, or Firm*—Hamilton, Brook, Smith & Reynolds

[57] ABSTRACT

In a cryopump, condensation of gases such as argon, oxygen and nitrogen on surfaces other than the second stage array 38, 40 is avoided to prevent cross over hang up and pressure instability. To prevent condensation of argon, oxygen and nitrogen on the frontal cryopumping array 46, that array is held to a temperature of at least 50° K. A heat load to the first stage increases as the temperature of the first stage drops. That heat load is provided by a high emissivity radiation shield 44 or by a thermal switch 56, 58. Condensation of argon and other gases on the second stage refrigerator cylinder 32 is avoided by a close fitting sleeve 52 positioned over the refrigerator cylinder 32 in thermal contact with the second stage heat sink 30 but out of thermal contact with the cylinder 32.

14 Claims, 3 Drawing Figures

CRYOPUMP WITH RAPID COOLDOWN AND INCREASED PRESSURE

This application is a continuation of U.S. Ser. No. 481,783 filed 4/4/83, now abandoned.

DESCRIPTION

1. Technical Field

This invention relates to cryopumps and has particular application to cryopumps cooled by two stage closed cycle coolers.

2. Background

Cryopumps currently available, whether cooled by open or closed cryogenic cycles, generally follow the same design concept. A low temperature second stage array, usually operating in the range of 4 to 25 K, is the primary pumping surface. This surface is surrounded by a higher temperature cylinder, usually operated in the temperature range of 70 to 130 K, which provides radiation shielding to the lower temperature array. The radiation shield generally comprises a housing which is closed except at a frontal array positioned between the primary pumping surface and the chamber to be evacuated. This higher temperature, first stage, frontal array serves as a pumping site for higher boiling point gases such as water vapor.

In operation, high boiling point gases such as water vapor are condensed on the frontal array. Lower boiling point gases pass through that array and into the volume within the radiation shield and condense on the second stage array. A surface coated with an adsorbent such as charcoal or a molecular sieve operating at or below the temperature of the second stage array may also be provided in this volume to remove the very low boiling point gases. With the gases thus condensed and or adsorbed onto the pumping surfaces, only a vacuum remains in the work chamber.

In systems cooled by closed cycle coolers, the cooler is typically a two stage refrigerator having a cold finger which extends through the rear of the radiation shield. The cold end of the second, coldest stage of the cryocooler is at the tip of the cold finger. The primary pumping surface, or cryopanel, is connected to a heat sink at the coldest end of the second stage of the coldfinger. This cryopanel may be a simple metal plate or an array of metal baffles arranged around and connected to the second stage heat sink. This second stage cryopanel also supports the low temperature adsorbent.

The radiation shield is connected to a heat sink, or heat station at the coldest end of the first stage of the refrigerator. The shield surrounds the first stage cryopanel in such a way as to protect it from radiant heat. The frontal array is cooled by the first stage heat sink through the side shield or, as disclosed in U.S. Pat. No. 4,356,701, through thermal struts.

One problem that has been experienced by certain users of cryopump systems is known as cross over "hang up". This problem is of particular concern in systems such as sputtering systems where the process is carried out in an argon, oxygen or nitrogen environment. Cross over is the processing step in which a valve between the work chamber and cryopump is opened to expose the very high vacuum cryopump to a lower vacuum work chamber. The pressure of the work chamber is then reduced by the cryopump. To bring the work chamber pressure to a vacuum of, for example, $10^{-7}$ torr, it is necessary that, in the case of argon, the gas be condensed on the cold, second stage array at a temperature of 28.6 K. Condensation of argon at higher temperatures results in a higher partial pressure of the argon and thus a higher pressure in the work chamber.

During normal operation of the system in which the first stage array is held at a temperature of, for example, 77 K, the argon does not condense on the first stage array but passes directly to the second stage array for proper condensation on that array. However, under low thermal load conditions the frontal array temperature can drop to as low as about 40 K. At that temperature argon does condense on the frontal array; and at that temperature the partial pressure resulting from the balanced evaporation of solid argon and condensation of argon molecules results in a partial pressure of only $10^{-3}$ to $10^{-4}$ torr. So long as any argon is in this state of sublimation on the frontal array, the pressure in the work chamber cannot be taken down to the desired $10^{-7}$ torr.

As the argon gas evaporates during sublimation, it eventually migrates to the colder second stage and is captured by that stage. However, the sublimation process is a slow one and until complete the pressure in the system "hangs up" at the higher pressure.

As a possible solution to "hang up", it has been suggested that the first stage arrays be made warmer by introducing an electrical heat load onto the first stage to prevent excessive cooling of that stage. However, a load on the stage generally increases cooldown time of the refrigerator. Minimizing cooldown time is a significant concern in designing cryopump systems. Further, electrical elements can present a hazard where the concentration of hydrogen is high.

Another problem associated with cryopump systems is that a pulsed thermal load can result in erratic pressure in the work chamber. For example, as a low emissivity valve door is opened to expose the frontal array to a higher emissivity radiating surface, the thermal load is increased, and the pressure may become unstable.

DISCLOSURE OF THE INVENTION

In accordance with the principles of this invention, cross over hang up in a cryopump is avoided by providing a passive heat load to the first stage to assure that the first stage is held at a temperature above about 50 K. During initial stages of cooldown, the passive heat load is substantially less than that at the final cooldown temperature condition, so that cooldown time is not substantially affected.

Preferably the heat load is due to radiant heating of a radiation shield. To increase the radiation heat load to the first stage, the effective emissivity between at least a portion of the radiation shield and the vacuum vessel is increased. At low temperatures of the first stage, the radiation heat load on the first stage is great due to the fact that the heat flux is a function of the difference in temperatures to the fourth power. As a result, when the first stage drops to a temperature near 50 K the heat load is substantial and prevents the first stage from dropping to a temperature below 50 K. It has been found that, so long as the temperature is held above 50 K, cross over hang up is avoided. At higher temperatures, the temperature differential between the radiation shield and the vacuum vessel is less and, due to the fact that the radiation heat flux is a function of the difference in temperatures, the load is substantially less. When the system is initially at ambient temperature, the heat load is negligible. Thus, by providing a radiation heat load to the first stage, that heat load is minimized at cooldown temperatures but is significant enough at very low temperatures to prevent the first stage from dropping to a temperature below 50 K. Cooldown time is not significantly hampered and cross over hang up is avoided.

Preferably, the effective emissivity between the radiation shield and vacuum vessel is obtained by painting the outer surface of the radiation shield black. Painting of the inner surface of the vacuum vessel would also increase the effective emissivity, but might result in outgasing from the paint at the higher temperatures of the vacuum vessel.

A problem related to cross over "hang up" can occur as a result of condensation of gases on the side of the second stage refrigerator cylinder. This problem is particularly apparent where an open second stage array is used to provide for maximum flow to an adsorbent material on the back side of the array. At normal operating temperatures, there is a temperature gradient along the length of the refrigerator cylinder from the approximately 77 K first stage heat sink to the 15 K second stage heat sink. Argon and other gases can condense along a zone of the refrigerator cylinder which is at a temperature of less than 50 K. The temperature of that zone is determined by the system pressure. When a thermal load is applied to the first stage, as by opening a valve in the system, the first stage temperature increases and shifts the 50 K zone along the length of the refrigerator cylinder. As that zone shifts, gas which had been frozen out on the cylinder is rapidly liberated. That rapid evaporation results in a sharp increase in the work chamber pressure. Further, even when the thermal load on the first stage is constant, a displacer within the refrigerator cylinder reciprocates and causes continuous movement of the critical zone. That movement of the critical zone results in a high frequency fluctuation of the pressure in the work chamber.

To avoid the problems caused by condensation of argon and other gases on the second stage refrigerator, a close fitting sleeve surrounds the refrigerator cylinder. That sleeve is in thermal contact with the second stage heat sink but is not in contact with the refrigerator cylinder. Most gas which passes the second stage array is condensed on the shield before it reaches the cylinder. The narrow gap of about 0.1 inch or less between the shield and the cylinder assures that even gas which passes beneath the cylinder is quickly condensed on and thus captured by the cold shield. With the shield held at the low temperature of the second stage heat sink, gas which condenses on the shield is held there and does not subsequently evaporate with displacer motion or high heat load to the first stage.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

PREFERRED EMBODIMENTS OF THE INVENTION

Figure 1:
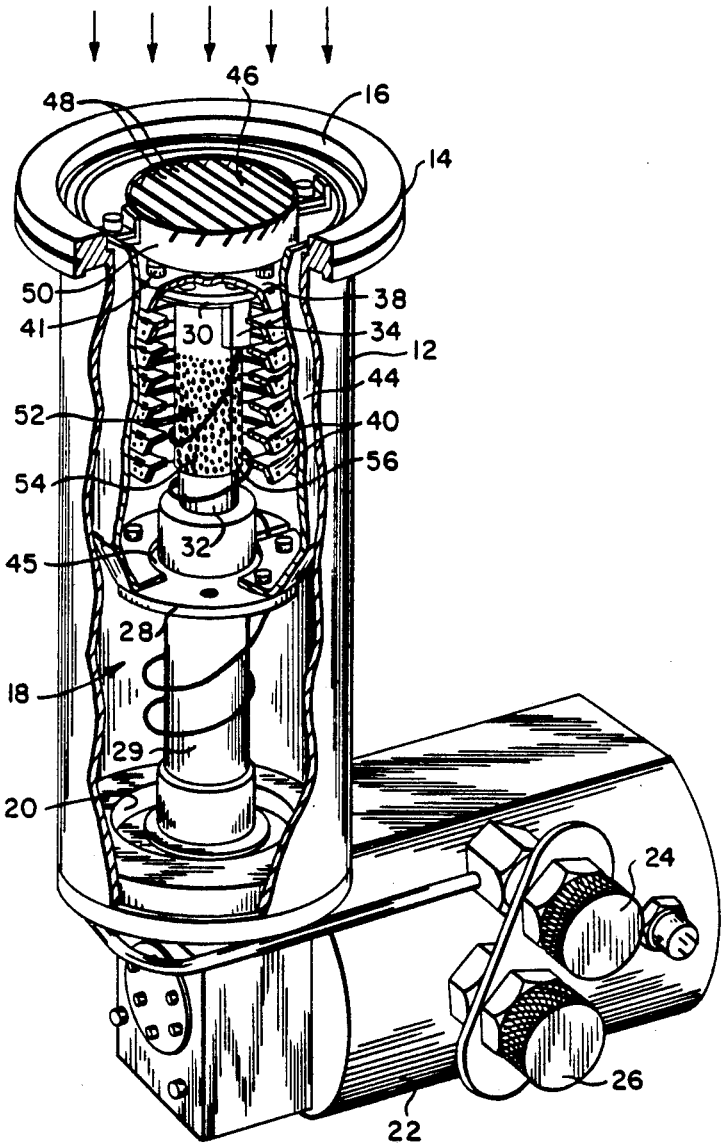
FIG. 1 is a perspective view of a cryopump embodying this invention.
Figures 2, 3:
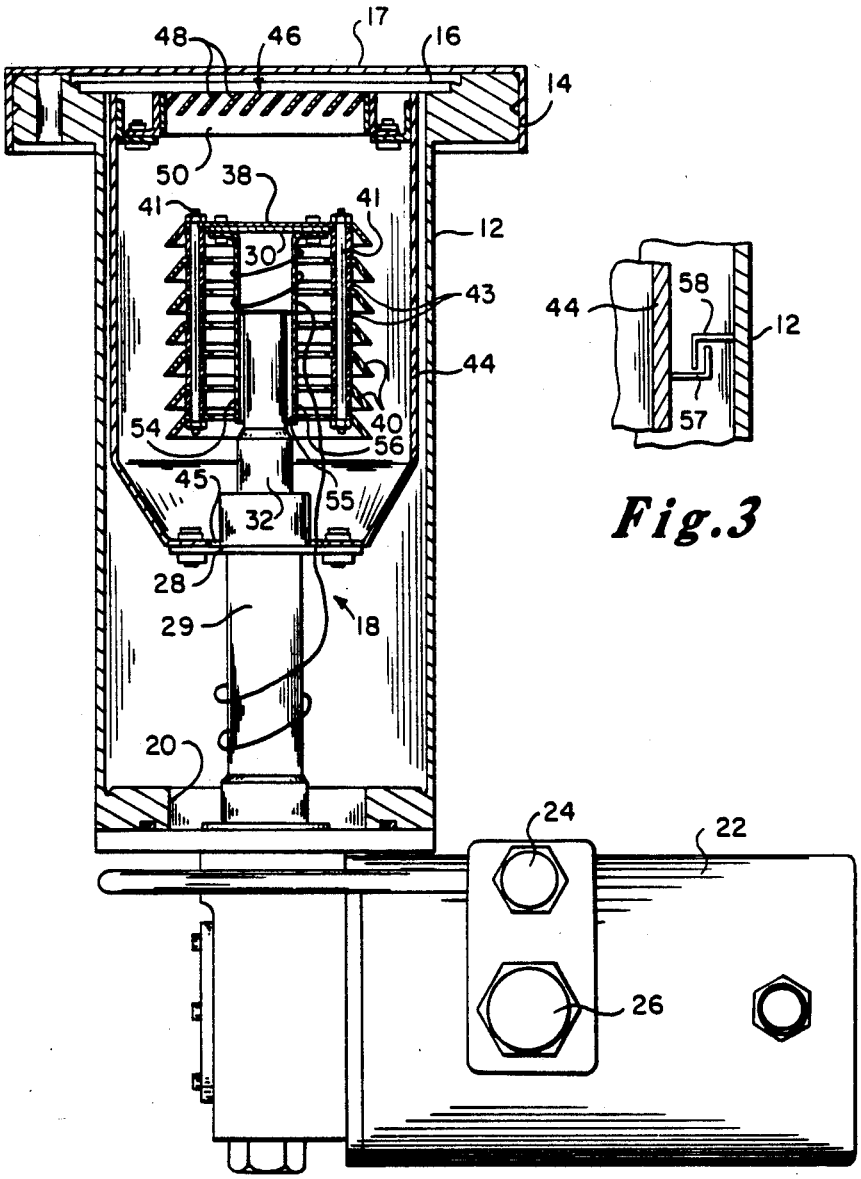
FIG. 2 is an elevational cross sectional view of the cryopump of FIG. 1.
FIG. 3 is an illustration of an alternative thermal switch embodiment.

The cryopump of FIGS. 1 and 2 comprises a vacuum vessel 12 which is mounted to the wall of a work chamber along a flange 14. A front opening 16 in the vessel 12 communicates with a circular opening in a work chamber. For shipment, a removable cover 17 is provided over the opening as shown in FIG. 2. Alternatively, the cryopump assembly may protrude into the chamber and a vacuum seal be made at a rear flange. A two stage cold finger 18 of a refrigerator protrudes into the vessel 12 through an opening 20. In this case, the refrigerator is a Gifford-MacMahon refrigerator such as disclosed in U.S. Pat. No. 3,218,815 to Chellis et al., but others may be used. A two stage displacer in the cold finger 18 is driven by a motor 22. With each cycle, helium gas introduced into the cold finger under pressure through line 24 is expanded and thus cooled and then exhausted through line 26. A first stage heat sink, or heat station, 28 is mounted at the cold end of the first stage 29 of the refrigerator. Similarly, a heat sink 30 is mounted to the cold end of the second stage 32. A suitable temperature sensor element 34 is mounted to the rear of the heat sink 30.

The primary pumping surface is an array mounted to the heat sink 30. This array comprises a disc 38 and a set of circular chevrons 40 arranged in a vertical array and mounted to disc 38 by thermal struts 41. The struts 41 extend through the chevrons 40 and cylindrical spacers 43 between the chevrons, and nuts at the ends of the struts compress the chevrons and spacers into a tight stack. A low temperature adsorbent such as charcoal particles is adhered to the lower, backside surface area of the chevrons. Access to this adsorbent by low boiling point gases is through the open chevrons 40. This open arrangement with the chevrons supported by struts, allows for simple assembly and also ready flow of gases past the front side of the chevrons 40 to the adsorbent. As an alternative, the chevrons could be supported on an inner cylinder to which adsorbent could adhere.

For reasons to be discussed below, a sleeve 52 is positioned over the second stage refrigerator cylinder 32. The sleeve 52 is formed of two hemicylindrical elements 54 and 56 which are mounted to and extend downward from the second stage heat sink 30. A small gap 55 is provided between the sleeve and the cylinder 32.

A cup shaped radiation shield 44 is mounted to the first stage, high temperature heat sink 28. The second stage of the cold finger extends through an opening 45 in that radiation shield. This radiation shield 44 surrounds the second stage array to the rear and sides to minimize heating of the array by radiation. Preferably the temperature of this radiation shield is less than about 120 K.

A frontal cryopanel array 46 serves as both a radiation shield for the primary cryopanel and as a cryopumping surface for higher boiling temperature gases such as water vapor. This array comprises louvers 48 joined by rim 50. The frontal array 46 is mounted to the radiation shield 44, and the shield both supports the frontal array and serves as the thermal path from the heat sink 28 to that array. The configuration of this array need not be confined to the arrangement shown but it should be an array of baffles so arranged as to act as a radiant heat shield and a higher temperature cryopumping panel while providing a path for lower boiling temperature gases to the second stage array.

As noted above, the problem of cross over hang up results from argon and other gases freezing on the first stage frontal array rather than passing directly through to the second stage array. Experiments have shown that hang up due to argon can be avoided by holding the temperature of the frontal array above 50 degrees. This in turn can be accomplished by providing a heat load to the first stage at low temperatures. On the other hand, it is preferred that the heat load of the first stage be minimized at higher temperatures in order to maintain high cooldown speeds. To that end, a radiation heat load is applied to the first stage by painting the outside of the radiation shield 44 with flat black paint. This increases the emissivity of the shield and increases the radiant heat flow from the vacuum vessel to the shield. That radiant heat flow is a thermal load on the first stage refrigerator.

The thermal load on the first stage is due to the radiant heat flow Q to the radiation shield 44:

$$Q = A\sigma e_{eff}(T_H^4 - T_L^4) \quad (1)$$

where A is the surface area, $\sigma$ is a constant, $e_{eff}$ is the effective emissivity, $T_H$ is the temperature of the vacuum vessel and $T_L$ is the temperature of the radiation shield.

The effective emissivity is a function of the emissivity $e_o$ of the outer surface of the radiation shield and the emissivity $e_i$ of the inner surface of the vacuum vessel:

$$e_{eff} = \frac{1}{1/e_o + 1/e_i - 1} \quad (2)$$

In the past, these surfaces have been polished to obtain very low emissivities of less than about 0.1 for an effective emissivity of less than about 0.05. That low effective emissivity minimizes radiant heat flow and the resultant load on the first stage. To provide a proper heat load to the first stage in accordance with this invention the effective emissivity should be at least about 0.10. This effective emissivity is obtained by an emissivity of the outer surface of the radiation shield 44 approaching one and the emissivity of the inner surface of the vacuum vessel 12 of about 0.1.

It is significant that the high emissivity is provided on the radiation shield 44 and not on the frontal array 46. With a high emissivity on the array 46, the effective emissivity could vary greatly. As a valve door to the work chamber opens, the emissivity seen by the array would change from 0.1 to near one. With an emissivity on the array of near one, the effective emissivity would change from about 0.1 to about one. This would result in a change in thermal load of several watts.

With the present arrangement the frontal array has an emissivity of about 0.1 so that as the valve opens the frontal effective emissivity only changes from about 0.05 to about 0.1. The effective emissivity between the radiation shield and vacuum vessel remains at about 0.1 regardless of the valve position. Thus, the first stage load remains much more constant at about one or two watts.

It can be noted that the radiation heat flow is a function of the difference in temperatures raised to the fourth power. Thus, as the temperature differential increases, the heat flow increases. It has been found that by painting the radiation shield 44 black, which provides a shield emissivity of about 0.9, a significant heat load on the first stage due to radiant heat flow is obtained at low temperatures of the first stage. That heat load is sufficient to keep the temperature of the first stage, including the frontal array 46, above 50 K. However, at higher temperatures the radiant heat load is much less significant and thus does not appreciably hamper cooldown of the system.

Another means for obtaining the desired load at only lower temperatures is illustrated in FIG. 3. In this arrangement, a thermal switch provides a conductive heat flow path between the vacuum vessel 12 and the radiation shield 44 at low temperatures. The switch is formed of bimetallic elements 56 and 58. At low temperatures approaching 50 K, these bimetallic elements come into contact and provide a heat flow path to the radiation shield 44 to prevent the temperature of the frontal array from dropping below 50 K. At higher temperatures, however, the elements are separated and the vacuum between the elements 56 and 58 provides good insulation.

A radiation heat load is preferred over the conductive heat load because it provides more uniform loading of the first stage and because it does not result in any structural changes to the system. Both radiation and conductive heat loads avoid the need for an electrical heating element in the system, and both provide increasing thermal loading as the first stage temperature decreases.

The heat load provided by the increased radiation to the radiation shield 44 prevents the condensation of argon and other low condensing temperature gases on the frontal array, but it was found that a problem still existed with the condensation of argon on the second stage refrigerator cylinder 32. Even at normal operating temperatures with the first stage heat sink 28 at 77 K and the second stage heat 30 at 15 K, a temperature gradient exists between those heat sinks along the length of the cylinder 32. The pressure of the chamber, for example $10^{-4}$ torr, determines a limited temperature range less than 50 K at which argon gas condenses and evaporates in equilibrium. Thus at all times, at some point along the length of the cylinder, there exists a critical zone on the cylinder 32 at a temperature at which argon gas condenses and evaporates in equilibrium. As the displacer within the cylinder 32 reciprocates up and down, that critical zone moves up and down along the cylinder. As the zone moves up, the region which had supported condensed argon warms to a higher temperature at which the argon evaporates. The fairly rapid evaporation of the argon results in a rise in the pressure of the system. As the displacer reciprocates, this oscillating movement of the critical region can be seen as an oscillation in the chamber pressure.

Another result of the argon condensation on the cylinder 32 is pressure instability with changes in the thermal load on the first stage. For example, when a valve is opened to the work chamber, the first stage is subjected to a large thermal load which increases the temperature of the first stage heat sink 28. This in turn causes a rapid shift in the critical zone and unstable pressure in the chamber.

It has been found that the condensation of argon on the cylinder can be virtually eliminated by positioning a close fitting shield 52 over the cylinder and maintaining that shield at a stable, low temperature. Most of the gas which passes through the second stage array and which would otherwise come into contact with the second stage cylinder 32 is intercepted by the shield. Further, any gases which are able to pass from below the shield into the region between the shield and the cylinder are soon captured on the inner surface of the shield. Once argon is condensed on the 15 K shield, evaporation is very limited. On the other hand, any gas which should condense on the cylinder does evaporate at a relatively faster rate. On balance, then, gas which enters the gap between the shield and the cylinder is quickly captured by the cylinder and condensation on the cylinder is virtually eliminated. A gap of 0.085 inch has been found suitable for this purpose.

While the invention has been particularly shown and described with reference to a preferred embodiment thereof, it will be understood by those skilled in the art that various changes in form and details may be made therein without departing from the spirit and scope of the appended claims. For example, a closed cycle, two stage refrigerator is shown. A cryopump cooled by an open cycle refrigerator such a liquid nitrogen, hydrogen or helium may also be used. Also combinations of single and two stage closed cycle refrigerators may be used to provide the cooling.

We claim:

1. A cryopump comprising a refrigerator having first and second stages, a second stage cryopumping surface in thermal contact with a heat sink on the second stage and held at a temperature of less than 50 K to condense low condensing temperature gases, a first stage cryopumping surface in thermal contact with a heat sink on the first stage and held at a temperature higher than the second stage to condense higher condensing temperature gases, a radiation shield surrounding the second cryopumping surface and in thermal contact with the first stage cryopumping surface, and a vacuum vessel surrounding the radiation shield and at a temperature substantially greater than the radiation shield, the improvement wherein:

the effective emissivity between at least a portion of the radiation shield and the vacuum vessel is such that a sufficient thermal load due to thermal radiation is imposed on the first stage, at a first stage temperature approaching 50 K, to assure that the temperature of the first stage cryopumping surface is, under all operating conditions, greater than about 50 K.

2. A cryopump as claimed in claim 1 wherein the outer surface of the radiation shield has high emissivity.

3. A cryopump as claimed in claim 2 wherein the emissivity of the radiation shield is about 0.9.

4. A cryopump as claimed: in claim 2 wherein the outer surface of the radiation shield is painted black.

5. A cryopump as claimed in claim 2 wherein argon, nitrogen and oxygen gas in the system is precluded from condensing on the first stage crypumping surface.

6. A cryopump as claimed in claim 1 wherein argon, nitrogen and oxygen gas in the system is precluded from condensing on the first stage cryopumping surface.

7. A cryopump comprising a vacuum vessel and first and second stage cryopumping surfaces in thermal contact with first and second refrigeration stages for respectively condensing predetermined high and low condensing temperatures gases, and means for providing a passive heat load to the first refrigerator stage due to thermal radiation from the vacuum vessel, the heat load due to thermal radiation being steady during operation at steady first stage temperatures and the passive heat load due to thermal radiation being low during cooldown of the cryopump and substantially higher at low first stage temperatures to assure that the temperature of the first stage cryopumping surface remains above a temperature at which the gases to be condensed on the second stage cryopumping surface are able to condense.

8. A cryopump as claimed in claim 7 wherein the means for providing a passive heat load is a high emissivity radiation shield in thermal contact with the first refrigeration stage.

9. A cryopump as claimed in claim 8 wherein the emissivity of the radiation shield is about 0.9.

10. A cryopump as claimed in claim 8 wherein said gases to be condensed on the second stage crypumping surface includes argon, nitrogen or oxygen.

11. A method of preventing crossover hang up in a cryopump having first and second refrigerator stages, a second stage cryopanel in thermal contact with the second stage and a radiation shield in thermal contact with the first stage, the radiation shield surrounding the second stage cryopanel, the method comprising providing a high emissivity surface on said radiation shield facing away from the second stage cryopanel to obtain a passive heat load to the first stage due to thermal radiation absorbed by the radiation shield to assure that the first stage is held at a temperature above about 50 K, the heat load being less at initial first stage temperatures.

12. A method as claimed in claim 11 wherein the passive head load is due to radiant heat flow.

13. A method as claimed in claim 12 wherein the passive heat load results from a high emissivity radiation shield.

14. A method as claimed in claim 13 wherein the emissivity of the radiation shield is greater than about 0.1.

* * * * *